US005660571A

United States Patent [19]

Nakayasu et al.

[11] Patent Number: 5,660,571

[45] Date of Patent: Aug. 26, 1997

[54] MUFFLING DEVICE FOR OUTBOARD PROPULSION MACHINE

[75] Inventors: Yoshikazu Nakayasu; Hiroaki Fujimoto, both of Hamamatsu, Japan

[73] Assignee: Sanshin Kogyo Kabushiki Kaisha, Hamamatsu, Japan

[21] Appl. No.: 97,776

[22] Filed: Jul. 26, 1993

[30] Foreign Application Priority Data

Jul. 24, 1992 [JP] Japan ..... 4-217341

[51] Int. Cl.[6] ..... B63H 21/36

[52] U.S. Cl. ..... 440/88; 440/900

[58] Field of Search ..... 440/77, 88, 900; 123/195 D; 181/214, 229, 264, 282, 255, 269

[56] References Cited

U.S. PATENT DOCUMENTS

| | | | |
|---|---|---|---|
| 3,810,526 | 5/1974 | Kawasaki | 181/229 |
| 4,109,751 | 8/1978 | Kabele | 181/229 |
| 4,623,313 | 11/1986 | Ferguson | 440/88 |
| 4,927,392 | 5/1990 | Makihara et al. | 440/88 |
| 4,997,398 | 3/1991 | Glen | 440/88 |
| 5,129,847 | 7/1992 | Mondek | 440/80 |
| 5,176,551 | 1/1993 | Blanchard et al. | 440/88 |
| 5,282,764 | 2/1994 | Glen | 440/88 |

FOREIGN PATENT DOCUMENTS

| | | |
|---|---|---|
| 61-44095 | 3/1986 | Japan . |
| 61-44096 | 3/1986 | Japan . |
| 1-182192 | 7/1989 | Japan . |
| 1-145599 | 10/1989 | Japan . |

*Primary Examiner*—Edwin L. Swinehart

*Attorney, Agent, or Firm*—Knobbe, Martens, Olson & Bear LLP

[57] ABSTRACT

Two embodiments of silencing devices for a marine propulsion unit that include an engine surrounded by a protective cowling and which is adapted to be detachably connected to the hull of the watercraft. The silencing devices include at least one expansion chamber positioned within the hull and connected to the interior of the protective cowling by a duct. The devices are tuned to silence the noises emanating from the engine which include the induction system noises and/or mechanical noises.

8 Claims, 2 Drawing Sheets

MUFFLING DEVICE FOR OUTBOARD PROPULSION MACHINE

BACKGROUND OF THE INVENTION

This invention relates to a muffling device for an outboard propulsion machine and more particularly to an improved silencing device for an outboard motor.

A wide variety of propulsion devices have been proposed for watercraft that are attached to the hull and which provide propulsion for the watercraft. An outboard motor is a typical example of such propulsion devices and includes an internal combustion engine that drives a form of propulsion mechanism such as a propeller or the like for propelling the watercraft. It is the normal practice to enclose the internal combustion engine in a protective cowling to protect it from the elements and also to improve the appearance of the unit. The protective cowling is also intended to serve a silencing function so as to silence noises generated from the engine operation from reaching the occupants of associated watercraft.

However, the internal combustion engine requires air for its operation and therefor the protective cowling is provided with an atmospheric air inlet device to admit air to the engine for combustion. However, these atmospheric air inlet devices thus permit noise emanating from the engine to reach the occupants of the watercraft.

To avoid some of these problems, it has been proposed to form the air inlet opening in the rear portion of the protective cowling and facing away from the watercraft. However, this gives rise to a problem in that water may enter the protective cowling and damage the engine or the engine auxiliaries contained within the protective cowling.

In order to avoid the water damage it has been proposed to provide a duct that extends from the protective cowling into the interior of the watercraft so that the air drawn for the engine operation will be substantially free of water. However, although these devices are effective in reducing the water drawn into the protective cowling, they actually transmit noises from the engine to the occupants of the watercraft. Although the engine itself may be provided with an air silencing device, there also noises generated by the engine and other propulsion components of the outboard motor and vibrations of the protective cowling that which will transmitted and at times amplified by such connecting ducts.

It is, therefore, a principle object of this invention to provide an improved silencing arrangement for a marine propulsion device.

It is a further object of this invention to provide an improved silencing device for a marine propulsion unit which permits effective silencing not only of the inducted air but of the mechanism itself from the occupants of the watercraft.

SUMMARY OF THE INVENTION

This invention is adapted to be embodied in a marine propulsion device that is adapted to be detachably connected to the hull of a watercraft and which contains a propulsion device for propelling the hull through a body of water. A protective cowling completely encloses a portion of the propulsion device. A silencing device is supported externally of the protective cowling and is acoustically designed to attenuate noise. Duct means interconnect the silencing device and the interior of the protective cowling for silencing the noises emanating from the propulsion device portion.

DETAILED DESCRIPTION OF THE PREFERRED EMBODIMENTS OF THE INVENTION

Figure 1:
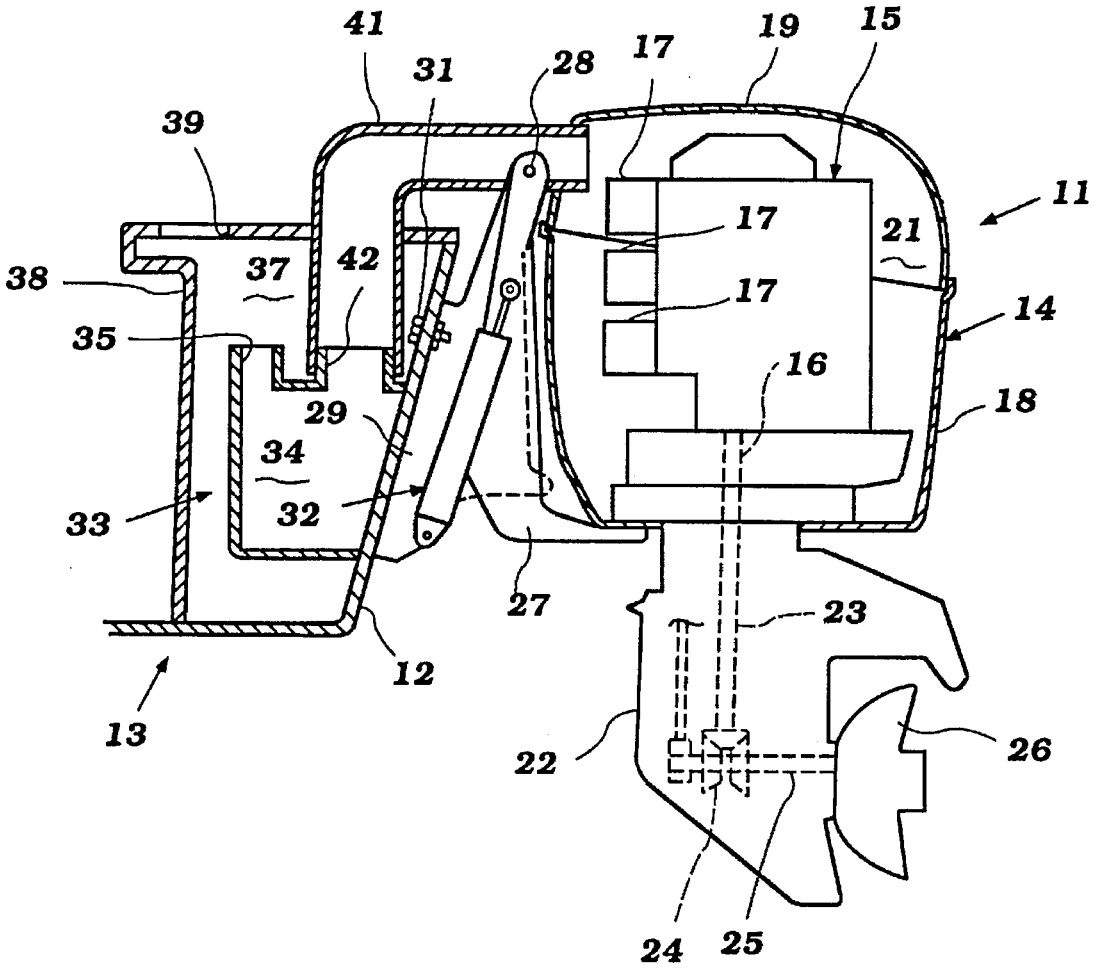
FIG. 1 is a side elevational view, with portions shown in a cross-section, of a marine propulsion device attached to the transom of an associated watercraft and constructed in accordance with a first embodiment of the invention.

Referring first to the embodiment of FIG. 1, an outboard motor constructed in accordance with this embodiment is identified generally reference numeral 11 and is shown attached to a transom 12 of a watercraft, indicated generally by the reference numeral 13. The method for attachment will be described later.

The outboard motor 11 is comprised of a power head assembly, indicated generally by the reference numeral 14, which is comprised of an internal combustion engine 15 supported, as is typical of outboard motor practice, with its output shaft 16 rotating about a vertically extending axis. In the illustrated embodiment, the engine 15 is of a three cylinder in line type and operates on a two cycle crankcase compression principle. Three air inlet ducts 17 are provided for admitting air into the crankcase chambers of the engine 15 for its combustion. The remaining internal details of the engine 15 are not important to the understanding of this invention and the invention can be utilized with any conventional type of internal combustion engine.

The power head 14 further includes a protective cowling that is comprised of a lower portion 18 and an upper portion 19 that are detachably connected to each other in any suitable manner. The cowling portions 18 and 19 may be formed from any suitable material such as a molded fiberglass reinforced resin or the like. The protective cowling defines a cavity or chamber 21 that extends around the engine 15.

A drive shaft housing and lower unit 22 depends from the power head 14 beneath the protective cowling portion 18 and includes a drive shaft 23 that is rotatably coupled to the engine output shaft 16 in a known manner. The drive shaft 23 drives a forward neutral reverse transmission 24 of the bevel gear type which, in turn, drives a propeller shaft 25 rotatably journalled in the drive shaft housing and lower unit 22. A propeller 26 is a fixed in a known manner to the propeller shaft 25 for propelling the watercraft 13 in a well known manner.

A swivel bracket 27 is connected to the outboard motor 11 by a pivotal connection for steering of the outboard motor 11 about a generally vertically extending steering axis in any well know manner. The swivel bracket 27 is pivotally connected by a pivot pin 28 to a clamping bracket 29 which is, in turn, a fixed in any suitable manner, as by fasteners 31 to the transom 12.

A hydraulic motor shock absorber assembly 32 is connected between the clamping bracket 29 and the swivel bracket 27 for controlling pivotal movement of the outboard motor 11 about a pivot axis defined by the pivot pin 28 for tilt and trim motion and popping up action as is well known in this art.

The induction air for the engine 15 is conventionally drawn from the cavity 21 through the air intake devices 17.

Normally it is the practice of outboard motors to employ of some kind of silencing device mounted on the air inlet devices 17 for silencing the induction air. However, it is necessary to provide in the protective cowling and normally the cover portion 19 an atmospheric air inlet that draws atmospheric air into the cavity 21. However, these atmospheric air inlets permit noise to emanate from within the protective cowling 18, 19 and annoy the occupants of the associated watercraft 13 as well as cause noise in the atmosphere. In addition, such devices also will permit water to enter into the protective cowling cavity 21 and cause damage to the motor 15 and other accessories contained therein.

In accordance with the invention, there is provided an external silencing device, indicated generally by the reference numeral 33, which will permit air to be drawn into the cavity 21 but which will isolate both the induction system noise and other noises from the mechanism of the propulsion unit from emanating to the atmosphere. This silencing device 33, in this embodiment, defines an expansion chamber 34 which may be formed in part by the transom 12. This expansion chamber 34 draws air through a restricted air inlet opening 35 from a further expansion chamber 37 formed by a separate baffle member 38 that is affixed to the hull 13 and which encloses the silencing device 33. This expansion chamber 37 has an upwardly facing air inlet opening 39. The opening 39 is of a smaller cross-sectional area than the expansion chamber 38 so that the inlet system provides a pair of expansion chambers each connected by restricted passageways.

The expansion chamber 34 delivers the air to the cavity 31 through a duct 41 which extends in part through the expansion chamber 37. The duct 41 may have either a sealed connection to the cowling portion 19 that will accommodate the tilt and trim operation and also the steering operation. Alternatively, the duct 41 may have a flexible section that will permit this movement while maintaining the air flow to the cavity 21.

The expansion chambers 37 and 34 and the respective openings 39, 35 and an opening 42 that communicates with a duct 41 may be sized to provide an acoustical tuning for not only the air induction system for the engine but also to silence any noises generated either by the engine 15 or other components contained within the protective cowling 18 and 19. In addition, since the atmospheric air is draw from well forward of the transom 12 there is little likelihood that any water may enter the system. In addition, since the opening 39, 35 and 42 all face upwardly at the upper portion of the respect expansion chambers 37 and 34 any water which may enter the system will fall to the bottom of the expansion chambers 37 and 34 and will not be drawn in to the cowling cavity 21.

Figure 2:
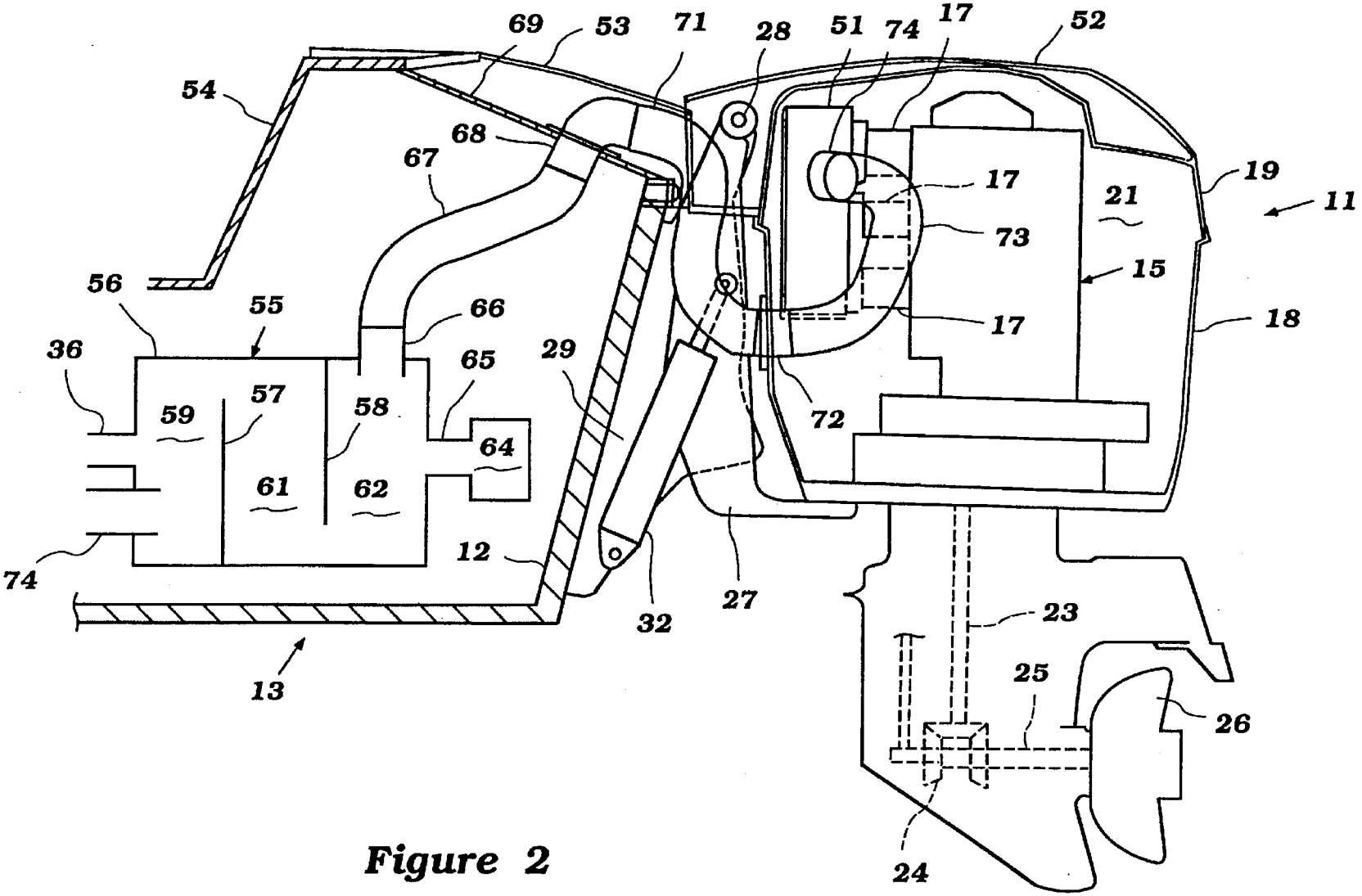
FIG. 2 is a side elevational view, with portions broken away, of a marine propulsion device and an associated watercraft constructed in accordance with another embodiment of the invention.

FIG. 2 shows another embodiment of the invention and in this embodiment the outboard motor and the basic hull configuration is substantially the same as that of the preceding embodiment and for this reason the components which are the same have been identified by the same reference numerals and will not be described again, except in so far as is necessary to understand the construction and operation of this embodiment.

In this embodiment, the air inlet devices 17 are provide with a common collector section 51 that is contained within the cavity 21 of the protective cowling 18, 19. This protective cowling includes a further cowling piece 52 that extends over the top of the cowling piece 19 and forwardly for cooperation with a further cowling piece 53 which is affixed to the watercraft hull 13 and specifically to a closure member 54 therefor.

Positioned beneath cowling member 54 is an air silencing device, indicated generally reference numeral 55 which is comprised of an outer housing 56 that is divided by baffles 57 and 58 into three expansion chamber portions 59, 61 and 62, respectfully that communicate with each other through opening's formed in the upper portion of baffle 57 and lower portion of the baffle 58 so as to provide a serpentine air flow through the expansion chambers 59, 61 and 62.

An atmospheric air duct 63 admits atmospheric air beneath the hull portion 54 into the expansion chamber 69. The inlet duct 63 may be tuned for length so as to provide a silencing effect in addition to the silencing effect provided by the three expansion chambers 59, 61 and 62. Furthermore, there is provided a fourth expansion chamber 64 that communicates with the expansion chamber 62 through a tuning neck 65. The volume of the expansion chamber 64 and the length and diameter of the tuning necks 65 are appropriately chosen so that the device will act as a Helmholtz resonator so as to attenuate a predetermined frequency of sound which may be either a sound generated by the engine induction system or a mechanical sound.

An upwardly extending outlet duct 66 extends from the expansion chamber 62 and communicates with a conduit 67 which, in turn, connects to an elbow 68 that passes through a wall 69 formed at the underside of the cowling portion 53. A flexible duct 71 interconnects the elbow 68 with a connecting tubing 72 that extends through the lower cowling portion 18 into the cavity 21. A final duct portion 73 connects the section 72 with an inlet pipe 74 of the air inlet device 51.

If desired a further tuned conduit 74 may connect the expansion chamber 59 with another silencing device (not shown). This other device may be tuned to attenuate frequencies not silenced by the device 55.

It should be seen that this embodiment also functions to provide not only dry inlet air to the engine 15 for its operations but also silences not only induction system noises but also any other mechanical noises from the engine 15 or other engine driven accessories contained within the protective cowling 18, 19.

It is to be understood that the foregoing description is that of preferred embodiments of the invention and that various changes in modifications may be made without departing from the spirit and scope of the invention, as defined by the appended claims.

We claim:

1. A marine propulsion device adapted to be detachably connected to the hull of the watercraft and containing a propulsion device for propelling the hull through a body of water, a protective cowling completely enclosing a portion of said propulsion device, a silencing device supported externally of said protective cowling and being acoustically designed to attenuate noise, said silencing device including at least one expansion chamber, said expansion chamber communicating with a further chamber through a tuning neck, said tuning neck and said expansion chamber being tuned to function as a Helmholtz resonator, and duct means inter-connecting said silencing device and the interior of said protective cowling for silencing the noises emanating from said propulsion device portion.

2. A marine propulsion device as set forth in claim 1 in combination with a watercraft comprising a hull and wherein the silencing device is positioned within said hull of said watercraft.

3. A marine propulsion device as set forth in claim 1 wherein the propulsion device includes an internal combustion engine which is the portion enclosed by the protective cowling.

4. A marine propulsion device as set forth in claim 2 in combination with a watercraft having a hull and wherein the silencing device is positioned with said hull of said watercraft.

5. A marine propulsion device as set forth in claim 4 wherein the silencing device includes a portion of the hull that surrounds and encloses an expansion chamber and defines a further expansion chamber.

6. A marine propulsion device as set forth in claim 5 wherein the enclosing portion of the hull is provided with an atmospheric air inlet.

7. A marine propulsion device as set forth in claim 6 wherein the hull enclosing portion is formed adjacent the transom of the hull.

8. A marine propulsion device adapted to be detachably connected to the hull of the watercraft and containing a propulsion device for propelling the hull through a body of water, a protective cowling completely enclosing a portion of said propulsion device, a silencing device supported externally of said protective cowling and being acoustically designed to attenuate noise, and duct means inter-connecting said silencing device and the interior of said protective cowling for silencing the noises emanating from said propulsion device portion, said silencing device comprising a plurality of expansion chambers communicating with each other through restricted openings.

* * * * *